United States Patent [19]

Asick

[11] 4,033,658

[45] July 5, 1977

[54] CONNECTOR ASSEMBLY ACCEPTING DIFFERENT SIZE POST CONTACTS THEREIN

[75] Inventor: John Carl Asick, Harrisburg, Pa.

[73] Assignee: AMP Incorporated, Harrisburg, Pa.

[22] Filed: Feb. 27, 1976

[21] Appl. No.: 661,887

[52] U.S. Cl. ..... 339/32 R; 339/210 M; 339/258 P

[51] Int. Cl.[2] ..... H01R 13/26; H01R 13/46

[58] Field of Search ..... 339/31, 32, 33, 176 M, 339/217 S, 192 R, 258 R, 258 P, 210 R, 210 M

[56] References Cited

UNITED STATES PATENTS

| | | | |
|---|---|---|---|
| 1,747,896 | 2/1930 | Gates | 339/217 S |
| 2,762,026 | 9/1956 | Knohl | 339/217 S |
| 3,335,394 | 8/1967 | Miller | 339/208 |
| 3,363,224 | 1/1968 | Gluntz | 339/258 R |
| 3,594,712 | 7/1971 | Enright et al. | 339/97 R |
| 3,668,604 | 6/1972 | Rossman | 339/210 M |
| 3,842,391 | 10/1974 | Dechelette | 339/32 R |
| 3,955,869 | 5/1976 | Licht | 339/32 R |

FOREIGN PATENTS OR APPLICATIONS

| | | | |
|---|---|---|---|
| 1,182,741 | 1/1959 | France | 339/32 R |
| 913,502 | 12/1962 | United Kingdom | 339/33 |

*Primary Examiner*—Roy Lake
*Assistant Examiner*—Neil Abrams

[57] ABSTRACT

An improved connector assembly is disclosed for accepting round, square, and rectangular post terminals therein from either side of the assembly through a profiled bore in the housing. A contact located within each profiled bore of the housing has a spring blade portion which engages the terminal pin with a substantially uniform force regardless of the shape of the terminal pin. The contacts can be formed with either solder tabs or crimp ears. The assembly is so designed that it can be utilized in many different configurations.

1 Claim, 31 Drawing Figures

Fig. 16
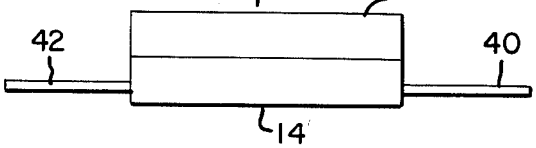
Fig. 22
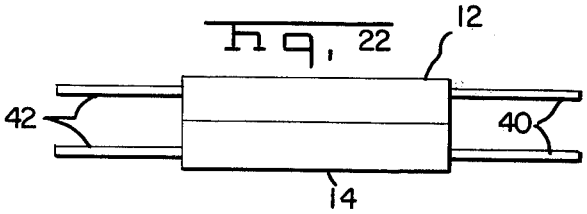
Fig. 17
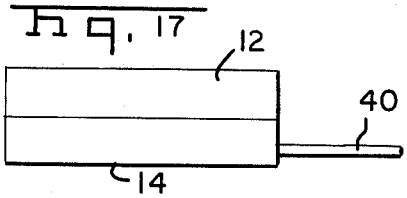
Fig. 23
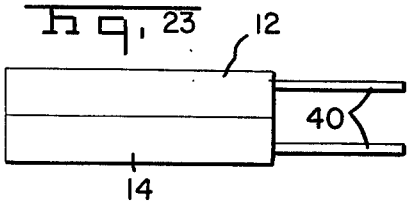
Fig. 18
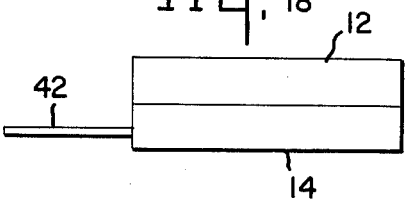
Fig. 24
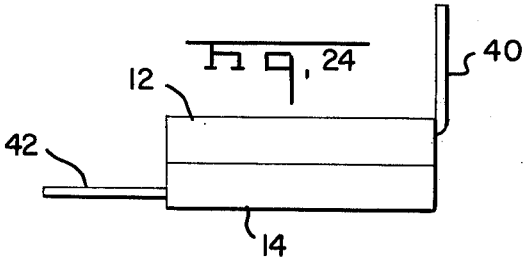
Fig. 19
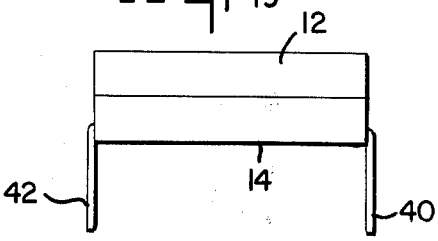
Fig. 6
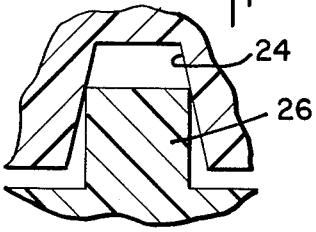
Fig. 7
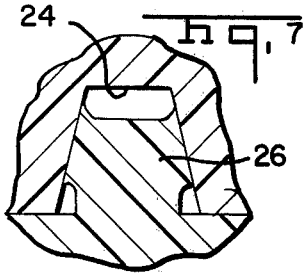
Fig. 20
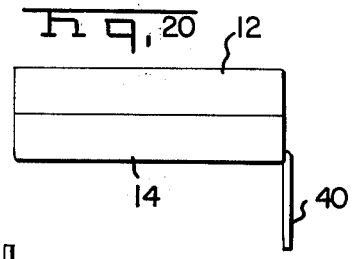
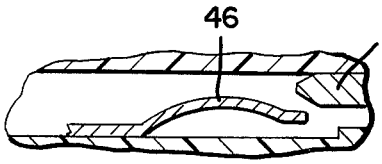
Fig. 25
Fig. 21
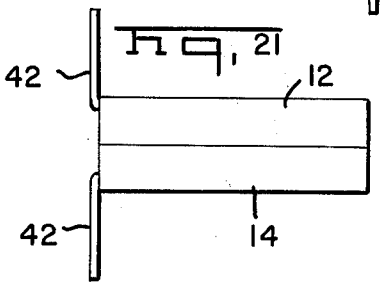
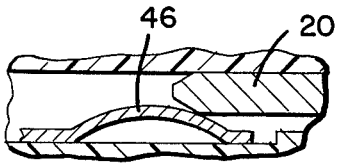
Fig. 26
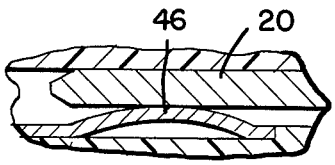
Fig. 27

CONNECTOR ASSEMBLY ACCEPTING DIFFERENT SIZE POST CONTACTS THEREIN

BACKGROUND OF THE INVENTION

1 The Field of the Invention

The present invention relates to an electrical connector assembly and in particular to a connector assembly which can accept terminal pins of different cross-sectional configurations inserted from either the front or back of the assembly.

2. The Prior Art

There are known electrical connectors which will accept mating members having terminals of different configurations. For example, U.S. Pat. No. 3,192,498 shows a contact which may receive either a mating pin or blade contact. There are also known receptacles, such as described in U.S. Pat. No. 1,591,337, which are of the duplex receptacle type and are capable of receiving plug prongs that are in either the conventional parallel spaced relation or spaced apart and normal to each other. There are also sockets, such as those shown in U.S. Pat. No. 2,229,377, which are capable of receiving contact blades of different widths.

Despite the fact that there are prior art teachings for electrical connectors capable of accepting mating members having terminals in different configurations, there has not heretofore been any teaching of a connector receptacle assembly which will apply equal force to terminals inserted therein regardless of the different cross-sectional configuration of the inserted terminal.

SUMMARY OF THE INVENTION

The present invention concerns an electrical connector assembly which is adapted to receive round, square, and rectangular terminal pins therein with a substantially uniform force being applied to the terminal pin regardless of its cross-sectional configuration. The housing of the subject connector includes a plurality of through bores having a generally T-shaped access opening at each end. The contact within the assembly includes a flat, body portion having a conductor engaging portion on at least one end thereof and a blade portion extending normal to the plane of the body and extending cantilever fashion along the body. The conductor engaging portions can include solder tabs, crimp ears, and insulation displacing slotted beam configurations. The contact can be formed out of a continuous strip of metal with the adjacent terminals either in aligned configuration for insertion into housings with the conductor engaging portions extending in a single direction or in opposing configuration to be inserted in housings with the conductor engaging portions extending in opposite directions.

It is therefore an object of the present invention to produce an improved electrical connector assembly which can accept terminal pins of different geometric cross sections.

It is another object of the present invention to produce an electrical contact assembly which will apply substantially uniform force to terminal pins inserted therein regardless of the shape of the terminal pins.

It is still another object of the present invention to produce an electrical contact having a cantilever spring arm portion and a conductor engaging portion, which may be either a solder tab or crimp ears, and in combination with profiled through bores of a housing will be received therein from either side of the housing terminal pins of round, square, or rectangular section with equal force applied to the terminal pin regardless of its section.

It is a further object of the present invention to produce an improved electrical connector assembly which can be readily and economically manufactured.

The means for accomplishing the foregoing objects and other advantages will be made apparent to those skilled in the art from the following detailed description taken with reference to the accompanying drawings.

BRIEF DESCRIPTION OF THE DRAWINGS

FIG. 6 is an enlarged detail showing the housing of FIG. 5 prior to ultrasonic bonding together of the housing members;

FIG. 7 is a view similar to FIG. 6 showing the housing members after the bonding operation;

FIGS. 16 to 24 are diagrammatic representations of the configurations of the solder tab embodiment of the contact which are available through the present invention;

FIGS. 25 to 27 are diagrammatic representations of the deflection of the beam portion of the subject contact;

DETAILED DESCRIPTION OF THE PREFERRED EMBODIMENTS

Figures 9, 10, 11:
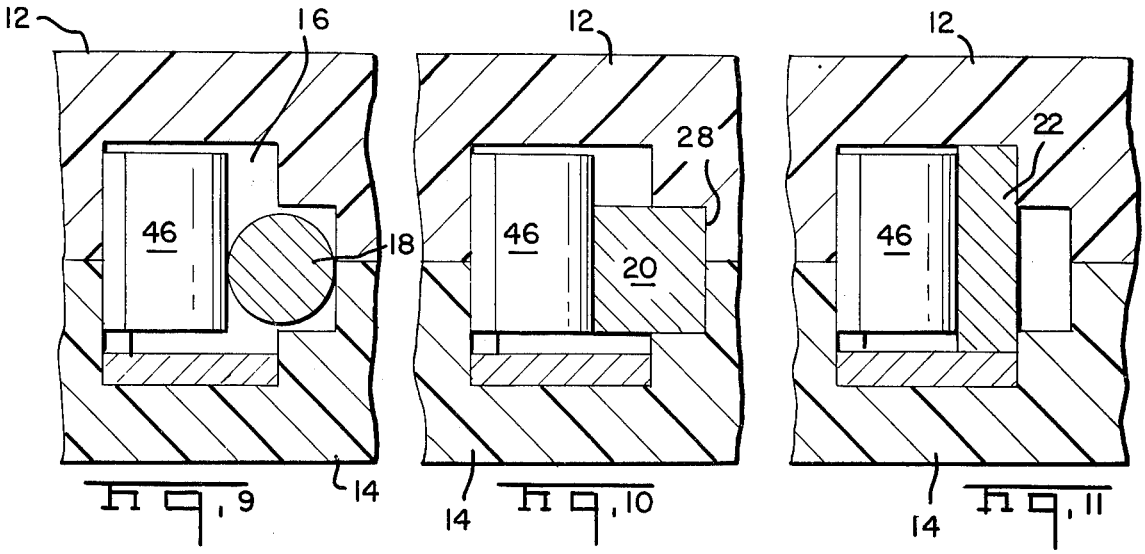
FIG. 9 is a section view showing a round terminal inserted into the subject connector assembly.
FIG. 10 is a view similar to FIG. 9 showing a square terminal pin inserted into the subject connector assembly.
FIG. 11 is a view similar to FIGS. 9 and 10 showing a rectangular terminal pin inserted into the subject connector assembly.
Figure 8:
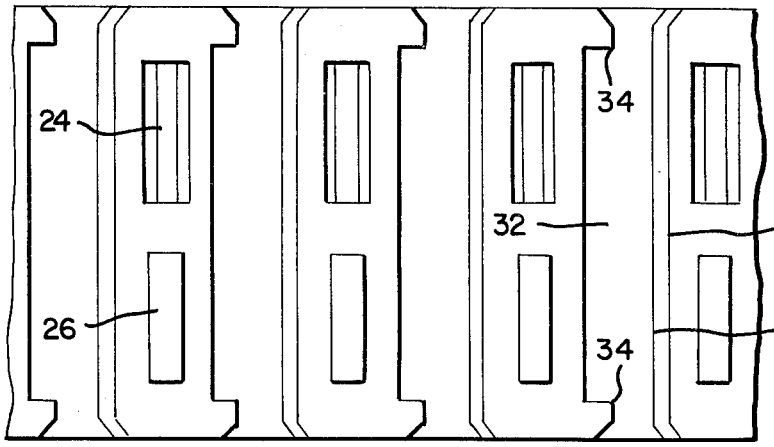
FIG. 8 is a plan view of one half of the housing of the subject connector assembly.

The subject connector assembly 10 includes a housing formed by identical mating members 12 and 14. The housing members 12, 14 together define therebetween a plurality of profiled through bores 16 which receive therein a round, square, or rectangular terminal pin 18, 20, and 22, respectively, as shown in FIGS. 9 to 11. The housing members 12, 14 are also each provided with a plurality of recesses 24 and projections 26 which mate with the corresponding recesses and projections of the opposite housing member. It will be noted from FIG. 6 that the recesses 24 have a trapoizoidal cross-section and the projections 26 have an initial square cross-section which is deformed by ultrasonic welding means (not shown) to bond the housing members together as shown in FIG. 7.

The profiled through bores 16 have substantially T-shaped openings at each end thereof, as shown in FIGS. 5, 9, 10 and 11. Each through bore is defined by a first step 28, which passes entirely through the housing and forms the base of the leg of the T-shape, and a second step 30 forming one end of the cross bar portion of the T-shape. A contact receiving cavity 32 extends in the housing members opposite to the first step 28 and is separated from the front and rear walls of the housing by abutments 34.

Figure 1:
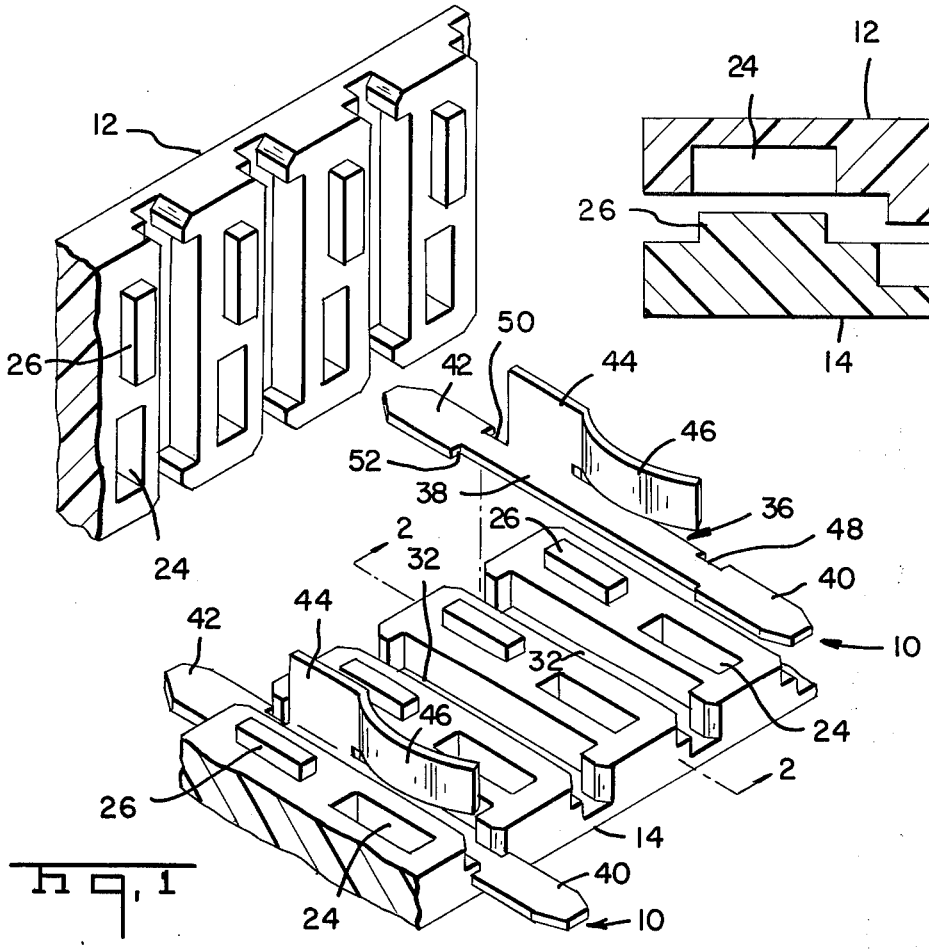
FIG. 1 is an exploded perspective view of the subject connector assembly with a solder tab embodiment of the contact.
Figure 2:
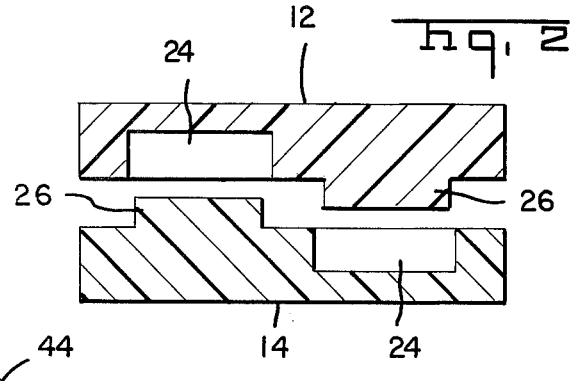
FIG. 2 is a vertical section taken along line 2—2 of FIG. 1.
Figure 3:
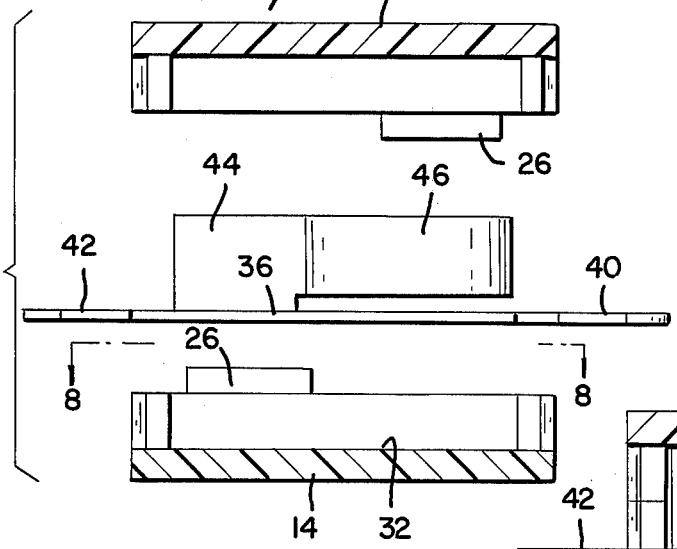
FIG. 3 is an exploded transverse section through the subject connector assembly.
Figure 5:
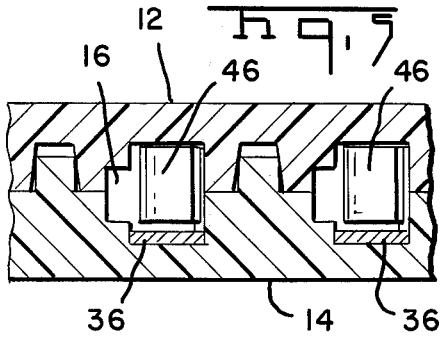
FIG. 5 is a fragmentary sectional view taken along line 5—5 of FIG. 4.
Figure 4:
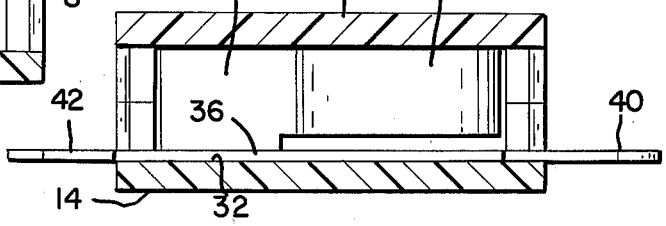
FIG. 4 is a sectional view, similar to FIG. 3, showing the subject connector assembly in the fully assembled condition.
Figure 12:
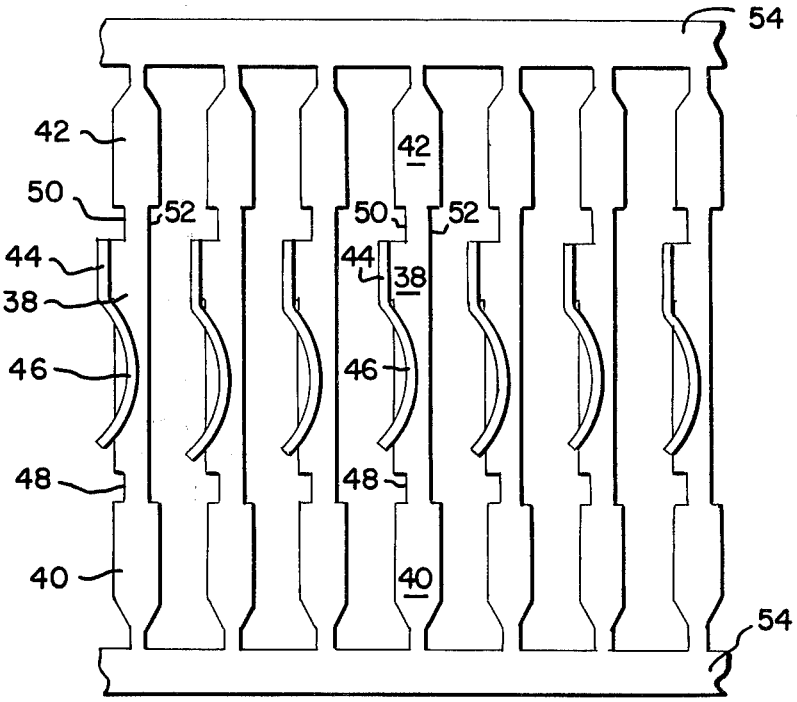
FIG. 12 is a plan view of a strip of contacts according to a first embodiment of the present invention.

The first embodiment of contact 36 is shown in FIGS. 1, 5, and 12 and includes a main body portion 38, mounting tabs 40, 42 extending from opposite ends of the body portion, and a contact blade 44 bent normal to the plane of the body portion 38 with a cantilever spring portion 46 extending therefrom. The body portion 38 is also provided on one side with notches 48, 50 at opposite ends thereof adjacent the tabs 40, 42, respectively, and an elongated notch 52 on the opposite side. The contacts 36 are preferably stamped and formed from a continuous strip of metal stock, as shown in FIG. 12, with the individual contacts connected on both ends to break away carrier strips 54. The notches 48, 50, and 52 serve to properly locate and fix the contact 36 in the housing with abutments 34 being received in notches 48, 50. Notch 52 allows for the tabs 40, 42 to be broader than the openings to the through bores 16 as well as to hold the contact in a fixed position.

The operation of the contact will be explained with reference to FIGS. 25 to 27. FIG. 25 shows the contact readied to receive a terminal pin. It should be noted that the spring arm 46 of the contact is in a free standing cantilever condition. FIG. 26 shows a terminal pin engaging the spring arm which bottoms against the housing before the pin is fully engaged. Thus the spring arm initially acts as a cantilever beam but soon begins to act as a double supported beam. This configuration allows for the assembly to receive round, square, and rectangular terminal pins while assuring uniform contacting force.

Figure 13:
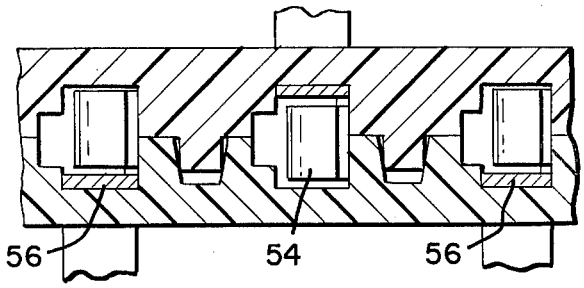
FIG. 13 is a section view showing an alternate mounting of the contacts into the subject connector assembly.
Figure 14:
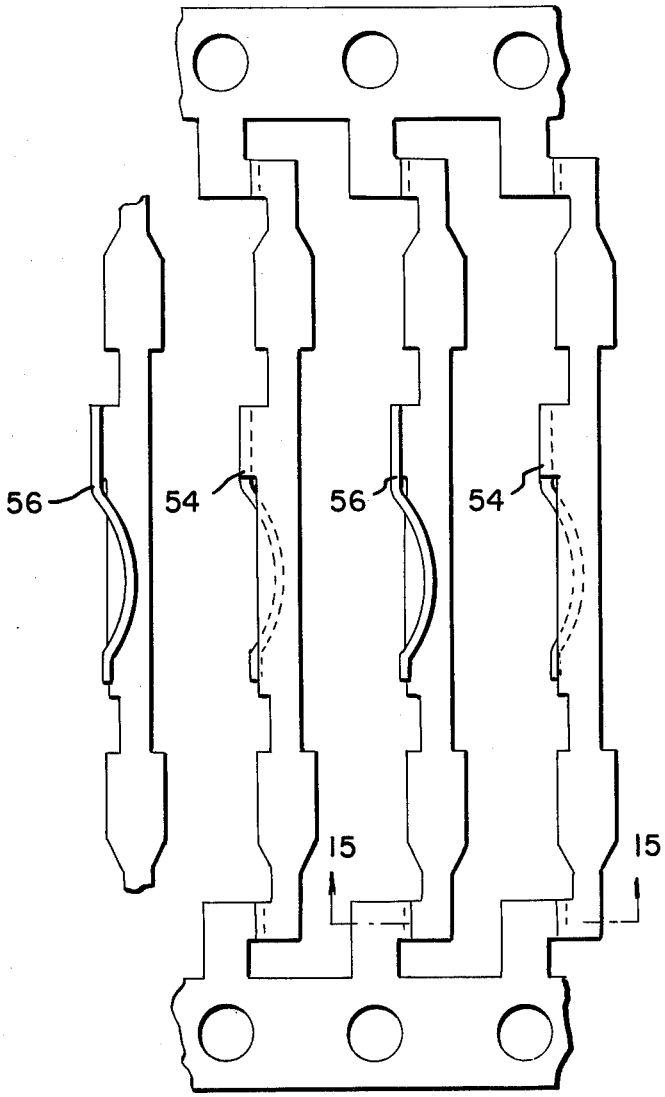
FIG. 14 is a plan view of a strip of contacts according to the first embodiment of the present invention formed for insertion into the housing as shown in FIG. 13.
Figure 15:
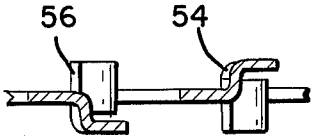
FIG. 15 is a partial section view taken along line 15—15 of FIG. 14.

A first alternate embodiment of the present invention is shown in FIGS. 13 to 15 and is applicable to situations when it is desirable to have the tabs extend in opposite directions from the housing, for example as shown in FIGS. 21 to 24. In this embodiment the adjacent contacts 54, 56 are identical but have been stamped and formed in opposite directions from the single continuous strip of metal, as best seen in FIG. 15. A strip of terminals formed in this manner can simply be mounted in a housing, as shown in FIG. 13, with the tabs thereof extending in opposite directions from the ends of the housing. It should be noted that for either mounting configuration, the contact is positioned in the housing with its spring arm opposite the leg portion of the T-shaped entrance.

FIGS. 16 to 24 illustrate several representative configurations of the tabs that are possible with the present invention. It is forseeable that other arrangements of the contacts are possible. The arrangements shown include severing the tabs from one end of the contacts as well as both leaving the tab extending in the plane of the housing and bending the tab to extend normal to the plane of the housing. The tabs can also extend from either or both ends of the housing and in either or both directions normal to the plane of the housing.

Figure 28:
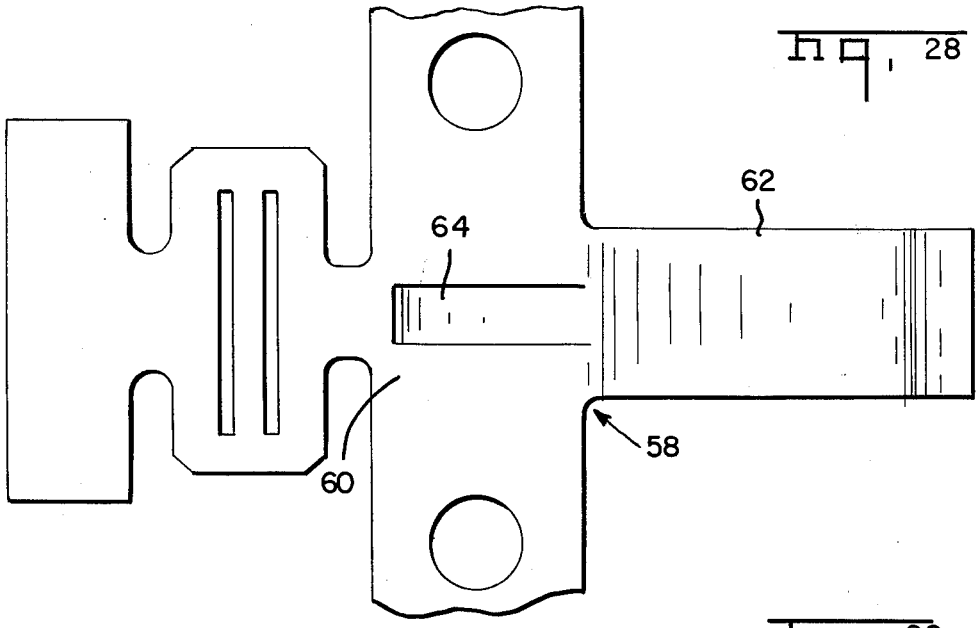
FIG. 28 shows a plan view of a strip of the subject contacts formed according to the second alternate embodiment with crimp tabs.
Figure 29:
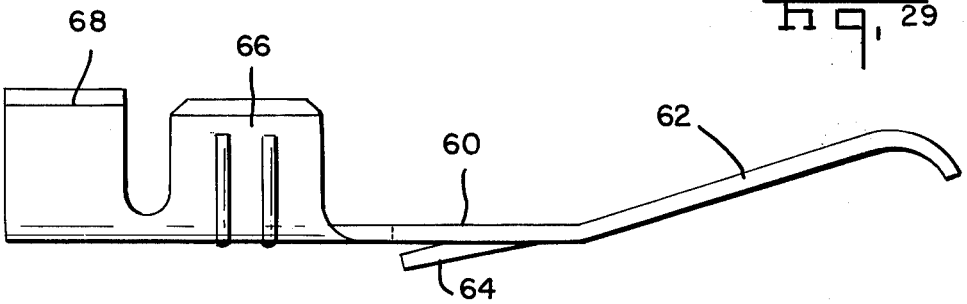
FIG. 29 shows a side elevation of one of the contacts shown in FIG. 28.

FIGS. 28 and 29 show a second alternate embodiment of the contact for the present connector assembly. In this embodiment the contact 58 includes a body portion 60 having a cantilever beam spring arm 62 extending therefrom, a lance 64 struck from the base of the body portion, and first and second spaced pairs of crimp ears 66, 68 adapted to be crimped onto the conductor and insulation portions, respectively of a wire.

Figure 30:
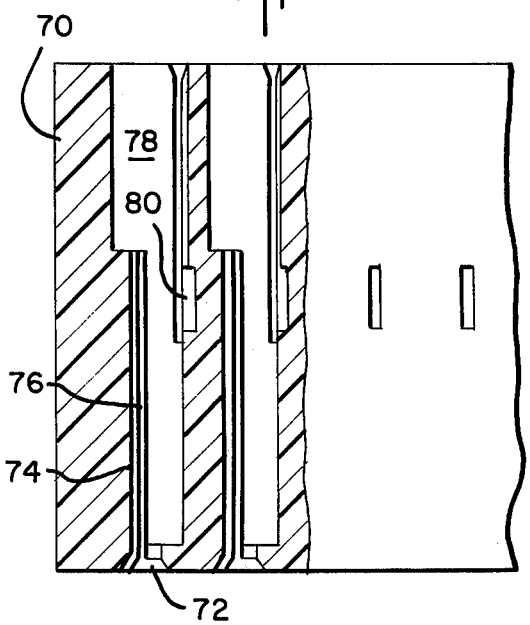
FIG. 30 shows a plan view of a modified housing adapted to receive the contact of FIGS. 28 and 29.
Figure 31:
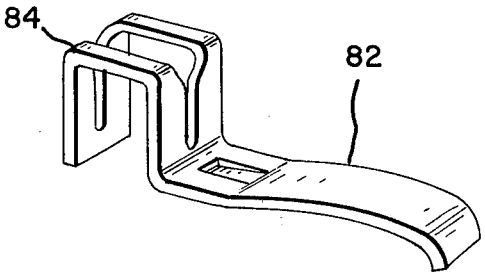
FIG. 31 shows another alternate embodiment of the contact for the subject connector assembly.

The modified housing member 70 of FIG. 30 defines profiled through bores having a T-shaped entrance 72 formed by first and second stepped recesses 74, 76, respectively. Cavity 78 is adapted to receive the contact body and aperture 80 receives the locking lance 64 to secure the contact in the housing. Cavity 78 is of sufficient size to receive the crimped ears 66,68 of the contact.

Contrary to the previous embodiments, this embodiment can receive round, square, or rectangular terminal pins from only a single insertion direction.

As a further alternative, the contact 82 could be formed with an insulation displacing portion 84 for engaging conductors. This embodiment would also use a housing similar to that shown in FIG. 30 and would receive terminal pins from one direction only.

The present invention may be subject to many modifications and changes without departing from the spirit or essential characteristics thereof. The present embodiments are therefore intended in all respects to be illustrative and not restrictive of the scope of the invention.

What is claimed is:

1. An electrical connector receptacle assembly capable of mating with a terminal pin having round, square, or rectangular section, with substantially uniform contact force being applied to said terminal pin regardless of its section, said connector assembly comprising:

a housing comprising a pair of identical mating housing members together defining therebetween a plurality of contact receiving cavities with a terminal pin receiving bore passing through each said cavity, each said bore having inwardly directed flanges at opposite ends thereof defining entrances with stepped profiles of lesser dimensions than the respective bore, a projection and a recess between each said cavity and bore mating with like projections and recesses in the opposite housing member with each projection bonded into a corresponding recess to permanently bond said housing members together; and a contact received in each said cavity, each said contact having an elongated body portion lying within said cavity, neck means at each end of said body engaging said entrance flanges for lockingly holding said contact in said cavity, a conductor engaging solder tab portion integral with each end of said body portion and extending from each end of said bore, said solder tab being at least as wide as said body portion, and a terminal pin engaging blade portion having one end integral with and extending normal to said body portion and lying aligned with the broadest portion of said stepped profile for engagement with terminal pins inserted therein, said blade having an initial cantilever position in which it first engages a terminal pin and a second double beam position in which its free end engages and is supported by said housing to apply uniform pressure to the pin terminal regardless of the sectional configuration thereof.

* * * * *